United States Patent [19]

Pirker et al.

[11] 4,168,817

[45] Sep. 25, 1979

[54] RAIL SWITCH

[75] Inventors: Robert Pirker, Zeltweg; Hannes Lindner, Leoben, both of Austria

[73] Assignee: Vereinigte Osterreichische Eisen- und Stahlwerke-Alpine Montan Aktiengesellschaft, Vienna, Austria

[21] Appl. No.: 857,357

[22] Filed: Dec. 2, 1977

[30] Foreign Application Priority Data

Feb. 10, 1977 [AT] Austria ..... 903/77

[51] Int. Cl.[2] ..... E01B 7/00

[52] U.S. Cl. ..... 246/391; 246/392; 246/422; 246/430

[58] Field of Search ..... 246/391, 392, 422, 430, 246/415 R; 104/103

[56] References Cited

U.S. PATENT DOCUMENTS 4,059,054 11/1977 Alimanestianu ..... 246/415 R

FOREIGN PATENT DOCUMENTS 9447 of 1909 United Kingdom ..... 246/391

*Primary Examiner*—Trygve M. Blix
*Assistant Examiner*—Reinhard J. Eisenzopf
*Attorney, Agent, or Firm*—Cushman, Darby & Cushman

[57] ABSTRACT

A rail switch in which two wing rails are engageable with a frog in alternation, characterized in that guide members are provided, which are held in position relative to the wing rails and extend under and are engageable with the frog or parts rigidly connected to the frog to prevent an upward movement of said guide members.

9 Claims, 5 Drawing Figures

RAIL SWITCH

This invention relates to a rail switch, in which two wing rails are engageable with a frog in alternation. Adjacent to the frog, the wing rails are guided on a base plate, which takes up the load from the rails. Because the base plate is rigidly connected to the frog, the wing rail cannot be lowered relative to the frog. In the known rail switches, however, the load applied by a wheel which is rolling close to and on the frog may cause the wing rails to rise relative to the frog. Such rising of the wing rails results in an unsteady movement of the wheel over the rail switch and also in generation of noise because the wing rail which has been raised is subsequently beaten against the base plate by the wheel.

It is an object of the invention to eliminate that disadvantage. The invention resides essentially in that guide members are provided, which are held in position relative to the wing rails and extend under and are engageable with the frog means, this expression being intended to include the frog itself and parts rigidly connected to the frog to prevent an upward movement of the guide members. These guide members support the wing rails to prevent a movement thereof relative to the frog so that a raising of the wing rails is reliably prevented. The rail head of the wing rail lies in the wheel-engaging plane as far as to the pointed end of the frog. Behind the pointed end of the frog, the wing rails are provided with extensions having a top surface disposed below the wheel-engaging plane. In accordance with the invention the guide members are preferably fixed to these extensions of the guide rails. In a suitable arrangement the guide members extend under the rail feet of the track rails which are connected to the frog. Any rise of the wing rails will be larger adjacent to these extensions than adjacent to the pointed end of the frog. The wing rails are held down more effectively because the guide members are disposed adjacent to these extensions and spaced apart from the pointed end of the frog.

In a desirable arrangement according to the invention, each guide member extends under the frog or the rail feet of a track rail connected to the frog when the associated wing rail is in engagement with the frog and when the associated wing rail is disengaged from the frog. As a result, a guide member cannot collide with the frog or with the rail foot of the track rail connected to the frog during a shifting of the associated wing rail toward the frog. In accordance with the invention, a clearance between the guide members and the underside of the frog or of the rail feet is readily permissible when the wing rails are disengaged from the frog. In that case the guide member will not engage the underside of the frog or of the adjoining track rail until the associated wing rail has been shifted into engagement with the frog and/or a wheel is rolling on said wing rail. When a guide member in question is fixed to the extension of the associated wing rail, such clearance adjacent to the pointed end of the frog will permit only of slight rises, which are still tolerable. During the shifting of the rail switch, one wing rail is shifted toward the frog and the other wing rail is shifted away from the frog, so that the guide members connected to the wing rails perform a horizontal movement relative to the frog. For this reason, the guide members in a preferred embodiment of the invention are provided with rollers, which consist preferably of plastics material. This feature enables a precise guidance so that even the slightest rise of the wing rails can be prevented. The rollers afford the advantage that there is no longer a need for lubrication, which is inherently problematic with rail switches which are exposed to the weather. The use of rollers made of plastics material affords the advantage that the rollers cannot rust. Such rollers of plastics material have desirable rolling properties and are in flow-friction contact with their axles. Self-lubricating plastics material may also be used.

In accordance with the invention, the guide members may alternatively consist of simple L-shaped members, which are secured to the wing rail or the extension thereof and have end portions by which the frog or the track rails connected thereto are engageable from below. Unless there is a wheel moving on the rail switch, the wing rail will not tend to rise so that the guide member will not apply a high pressure to the underside of the frog or the underside of the rail feet of the connected track rails when the wing rail is disengaged from the frog and possibly also in other positions of the wing rail. In an arrangement in which there is a clearance between the guide members, on the one hand, and the underside of the frog or the undersides of the track rails connected to the frog, on the other hand, these guide members will not engage the underside of the frog or of the track rails connected to the frog unless a wheel is moving on the wing rail in question so that the guide member may consist of a simple L-shaped member if the smoother movement over the rail switch which is enabled by the rollers of plastics material is not insisted upon.

An embodiment of the invention is diagrammatically shown by way of example on the drawing.

FIG. 1 is a diagrammatic top plan view of a Vignol rail switch.

FIG. 2 an enlarged top plan view showing the frog and the wing rails,

Figure 1:
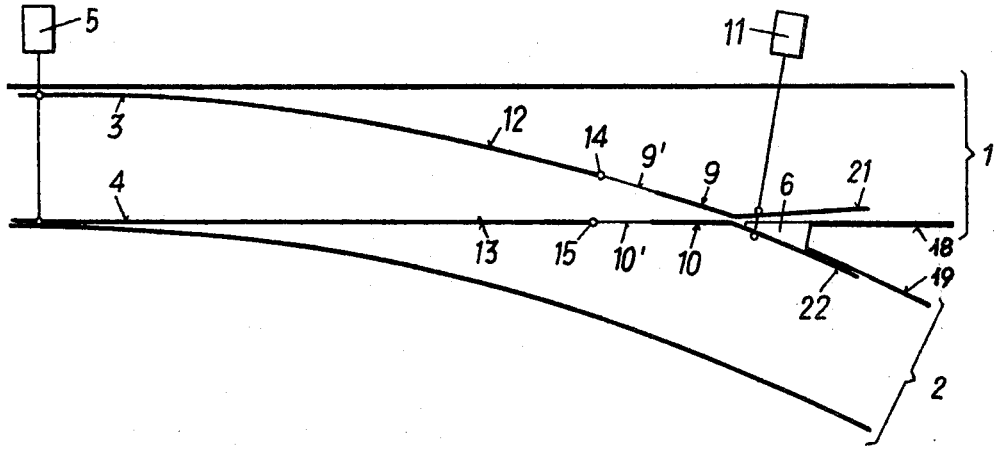
Figure 2:
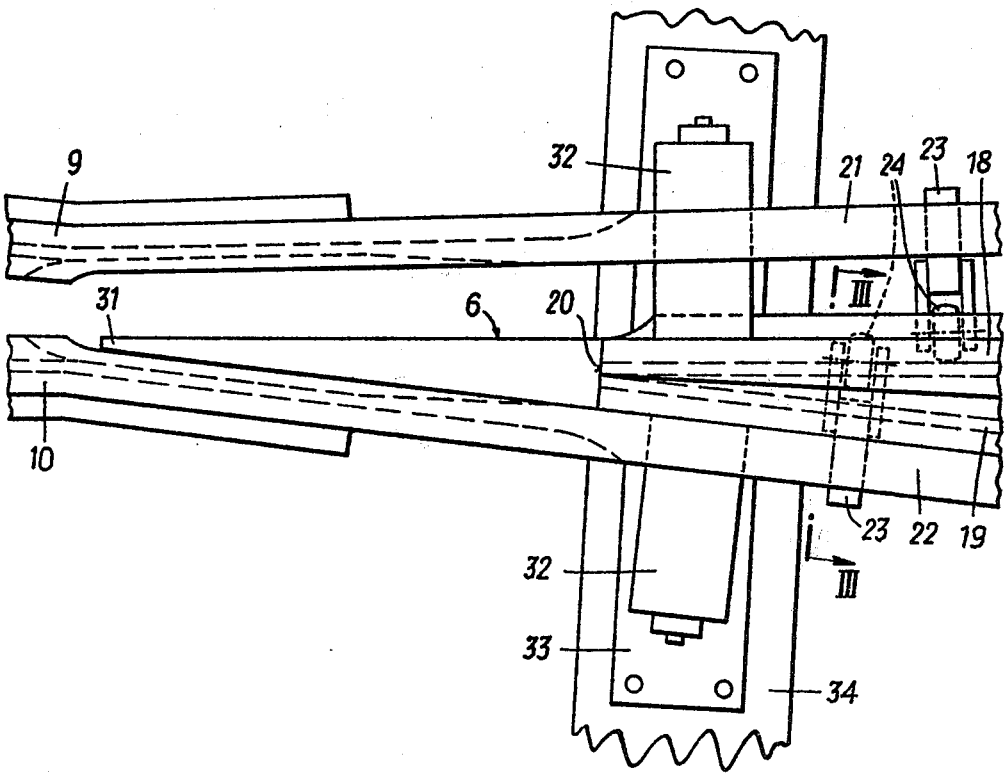

FIG. 1 shows a main track 1 and a branch track 2. Switch blades 3 and 4 are shiftable between positions in which they permit wheels to roll onto the main track 1 or onto the branch track 2. Means for shifting the switch blades are indicated at 5. A frog 6 having a pointed end is adjoined by track rails 18 and 19. Wing rails are indicated at 9 and 10. In the position shown in FIG. 1, the straight wing rail 10 engages the frog 6 and the curved wing rail 9 is disengaged from the frog. In this position, a wheel can roll on the main track. The means for actuating the wing rails 9 and 10 are indicated at 11. The wing rail 9 is connected to the wing blade 3 by a connecting rail 12. The wing rail 10 is connected to the switch blade 4 by a connecting rail 13. The wing rails are rigidly secured to the sleepers or ties at the joint 14 between the wing rail 9 and connecting rail 12 and at the joint 15 between the wing rail 10 and the connecting rail 13. In those portions 9' and 10' of the wing rails 9 and 10 which adjoin the joints 14 and 15, the rail foot of the wing rails has been planed off so that the wing rails can be elastically deflected laterally.

The track rails 18 and 19 are welded to the frog 6 by a seam weld 20 with the results that the end portions of the track rails 18 and 19 form part of the frog means. The wing rail 10 engages the frog 6 and the wing rail 9 is disengaged from the frog 6. The wing rails are provided with extensions 21 and 22, which lie below the rail head. It is apparent from FIGS. 3 and 4 that L-shaped members 23 are bolted to these extensions 21 and 22 and are angled toward the track rails 18,19. Rollers 24 are rotatably mounted on axles 25 fixed to said L-shaped members and are in rolling contact with the underside 26 of the rail feet 27 of the track rails 18, 19. The roller 24 is mounted at the end of an arm 28, which extends under the rail feet of the track rails 18,19 and which is so long that the roller 24 engages the underside 26 of the rail feet 27 even when the wing rail is disengaged from the frog, as is shown for the wing rail 9. By this contact, a rising of the extensions 21, 22 of the wing rails 9,10 relative to the frog 6 will be prevented.

Figure 3:
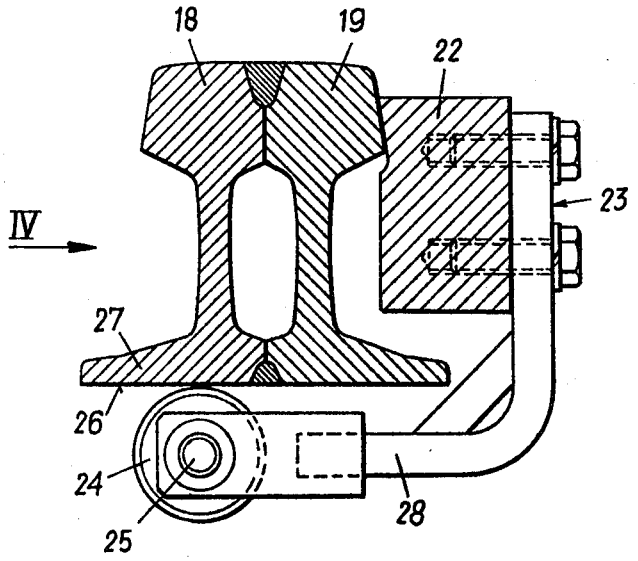
FIGS. 3 and 4 are enlarged views showing a guide member, FIG. 3 being a sectional view taken on line III—III in FIG. 2 and FIG. 4 an elevation taken in the direction of the arrow IV in FIG. 3 and showing the guide member which has been removed from the wing rail.
Figure 4:
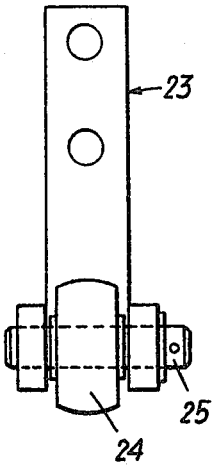
Figure 5:
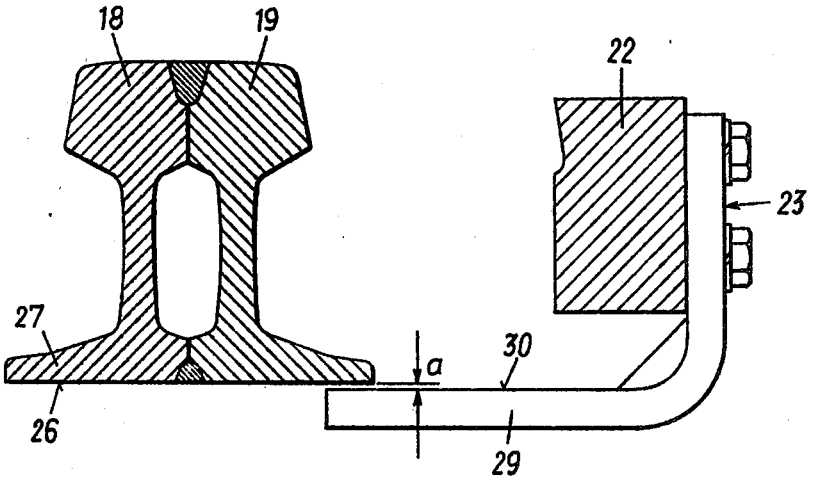
FIG. 5 is a view similar to FIG. 4 and shows a modification.

The embodiment shown in FIG. 5 differs from the embodiment shown in FIGS. 3 and 4 in that the L-shaped member 23 carrying rollers 24 which are mounted on the arm 28 is replaced by a simple L-shaped member 29, which is bolted to the extensions 21, 22 of the wing rails 9,10. In the embodiment shown by way of example of the drawing there is a slight clearance a amounting, e.g., to 2 to 5 mm, between the top 30 of the L-shaped member 29 and the underside 26 of the track rails 18,19 so that the wing rails 9,10 can be shifted even when they have been elevated as a result of stresses after prolonged use. Because these guide members 29 are considerably spaced behind the pointed end 31 of the frog, the clearance a has only such a slight effect adjacent to that pointed end of the frog that it can be tolerated. In the embodiment shown in FIG. 3 that clearance may be eliminated or may be smaller to provide for a smoother rolling of the wheels over the rail switch.

As the wing rails are shifted, they slide on lowfriction supports 32, which are mounted on plates 33 to which the sleepers or ties 34 are connected by screws.

We claim:

1. A rail switch having frog means including a frog, in which switch two wing rails which overlie sleepers are engageable with the frog in alternation, said switch including a guide member fixed to each wing rail and extending under and engageable with the frog means, when the wing rails are in both abutting and laterally displaced positions, to prevent an upward movement of said guide members and said wing rails, said guide members being arranged between sleepers.

2. A rail switch according to claim 1 wherein the wing rails have rail heads the upper surfaces of which define a wheel-engaging plane, and wherein the wing rails have an upper surface disposed below the wheel-engaging plane of the rail head.

3. A rail switch according to claim 1 wherein the frog means includes the end portions of track rails rigidly connected to the frog, said track rails having rail feet, characterized in that the guide members extend under said rail feet.

4. A rail switch as in claim 1 wherein the guide members are off-set from each other with respect to a plane transverse to the frog means.

5. A rail switch according to claim 1, characterized in that there is a clearance between each guide member and the underside of the frog means when the associated wing rail is disengaged from the frog means.

6. A rail switch according to claim 1, characterized in that the guide members are provided with rollers.

7. A rail switch according to claim 6, characterized in that the rollers consist of plastics material.

8. A rail switch according to claim 1, characterized in that the guide members include simple L shaped members, which are fixed to the wing rails and have end portions which extend under the frog means.

9. A rail switch as in claim 1 wherein the wing rails have extensions and wherein the guide members include simple L-shaped members which are fixed to said wing rail extensions and have end portions which extend under the frog means.

* * * * *